US006779797B1

(12) United States Patent
Chou

(10) Patent No.: US 6,779,797 B1
(45) Date of Patent: Aug. 24, 2004

(54) TARGET THROW PLAYING MACHINE HAVING RESTORING FUNCTION

(75) Inventor: Ai-Hua Chou, Jia Yi (TW)

(73) Assignee: Energy Star Co., Ltd., Jia Yi (TW)

( * ) Notice: Subject to any disclaimer, the term of this patent is extended or adjusted under 35 U.S.C. 154(b) by 0 days.

(21) Appl. No.: 10/639,295

(22) Filed: Aug. 12, 2003

(51) Int. Cl.[7] ..... F41J 7/04
(52) U.S. Cl. ..... 273/391; 273/398
(58) Field of Search ..... 273/390–392, 273/398, 402

(56) References Cited

U.S. PATENT DOCUMENTS 1,025,944 A * 5/1912 Elliott ..... 273/390
4,524,976 A * 6/1985 Seitz et al. ..... 273/388
4,550,918 A * 11/1985 Motsenbocker ..... 273/385
4,588,194 A * 5/1986 Steidle et al. ..... 273/391
4,917,388 A * 4/1990 Marquardt ..... 273/392
4,949,980 A * 8/1990 Hoy ..... 273/391
5,263,722 A * 11/1993 Rosellen ..... 273/391
5,342,062 A * 8/1994 Lance ..... 273/391
5,346,226 A * 9/1994 Block ..... 273/388

FOREIGN PATENT DOCUMENTS

DE 3534746 * 4/1987

* cited by examiner

*Primary Examiner*—Mark S. Graham
(74) *Attorney, Agent, or Firm*—Alan D. Kamrath; Nikolai & Mersereau, P.A.

(57) ABSTRACT

A target throw playing machine includes a main frame, and a throw portion. The throw portion includes a front plate, a plurality of targets, and a plurality of shafts. Each of the targets has a bottom provided with a movable block formed with a cutout and a chamfered portion. Each of the shafts is provided with a plurality of push members each having a first end selectively rested on the chamfered portion of the respective movable block or locked in the cutout of the respective movable block. Thus, the target throw playing machine has an automatically restoring function and has a rotation positioning function.

15 Claims, 13 Drawing Sheets

TARGET THROW PLAYING MACHINE HAVING RESTORING FUNCTION

BACKGROUND OF THE INVENTION

1. Field of the Invention

The present invention relates to a target throw playing machine, and more particularly to a target throw playing machine having an automatically restoring function.

2. Description of the Related Art

A conventional target throw playing machine in accordance with the prior art shown in FIGS. 11–13 comprises a front plate 61, a plurality of shafts 62, and a plurality of targets 64. Each of the shafts 62 is mounted on a rear portion of the front plate 61 and has two ends pivotally mounted the two sides of the front plate 61. Each of the targets 64 is mounted on a respective one of the shafts 62 and has a bottom having a rear end provided with a support seat 65 formed with a receiving recess 66 for receiving the respective the shaft 62. The support seat 65 is combined with a top cover 63 which has an inner wall formed with a catch portion 70. Each of the shafts 62 is provided with a plurality of push rings 71 each mounted in the receiving recess 66 of a respective one of the targets 64 and each secured on the respective shaft 62 to rotate therewith. Each of the push rings 71 is formed with a protrusion 72 rested on the catch portion 70 of the top cover 63.

In operation, when the ball hits one of the targets 64, the hitting force of the ball forces the target 64 to pivot downward about the respective shaft 62, so that the catch portion 70 of the top cover 63 is moved to abut the protrusion 72 of the respective push ring 71 as shown in FIG. 12. After the user finishes the throwing action of all of the balls, each of the shafts 62 is pivoted relative to the front plate 61 to rotate each of the push rings 71, so that the protrusion 72 of each of the push rings 71 is moved to push the catch portion 70 of the top cover 63 to move from the position as shown in FIG. 12 to the position as shown in FIG. 13, thereby returning each of the targets 64 to the original position.

However, when the hitting force of the ball applied on the target 64 is too large, the target 64 is easily returned to the original position due to the excessive hitting force of the ball. In addition, the protrusion 72 of the push ring 71 and the catch portion 70 of the top cover 63 are easily broken or worn out during a long-term utilization due to successive collision.

SUMMARY OF THE INVENTION

The primary objective of the present invention is to provide a target throw playing machine having an automatically restoring function.

Another objective of the present invention is to provide a target throw playing machine having a rotation positioning function.

A further objective of the present invention is to provide a target throw playing machine, wherein when the target is hit by the ball, the target is pivoted downward and is locked by the respective push member without movement, thereby preventing the target from being returned to the original position due to the excessive hitting force of the ball.

A further objective of the present invention is to provide a target throw playing machine, wherein each of the targets can be returned to the original position automatically by push of the oblique second end of each of the push members.

A further objective of the present invention is to provide a target throw playing machine, wherein the target throw playing machine has a simplified construction, thereby decreasing costs of fabrication.

A further objective of the present invention is to provide a target throw playing machine, wherein when the target is pivoted downward, the target is rested on the oblique second end of the respective push member, thereby preventing the target from being rotated excessively.

In accordance with the present invention, there is provided a target throw playing machine, comprising:

a main frame; and a throw portion mounted on the main frame and including a front plate, a plurality of targets, and a plurality of shafts, wherein:

the front plate is secured on a top of the main frame;

each of the targets is pivotally mounted on a rear portion of the front plate, and has a bottom provided with a movable block to pivot therewith;

the movable block has an end formed with a cutout and a chamfered portion;

each of the shafts is mounted on a rear portion of the front plate and is provided with a plurality of push members each mounted on a respective one of the targets; and each of the push members has a first end selectively rested on the chamfered portion of the respective movable block or locked in the cutout of the respective movable block.

Further benefits and advantages of the present invention will become apparent after a careful reading of the detailed description with appropriate reference to the accompanying drawings.

DETAILED DESCRIPTION OF THE INVENTION

Figure 1:
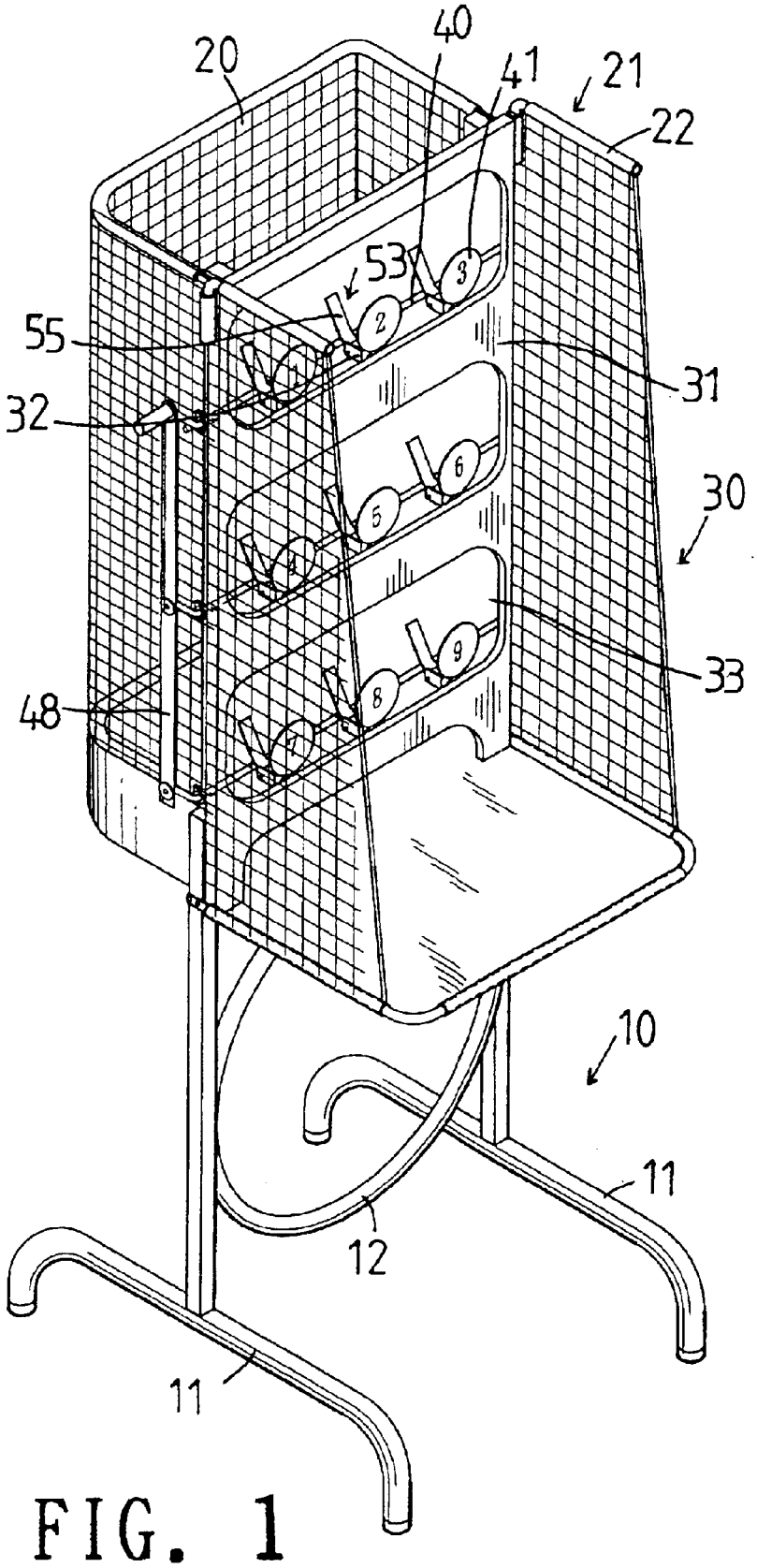
FIG. 1 is a perspective view of a target throw playing machine in accordance with the preferred embodiment of the present invention.
Figure 2:
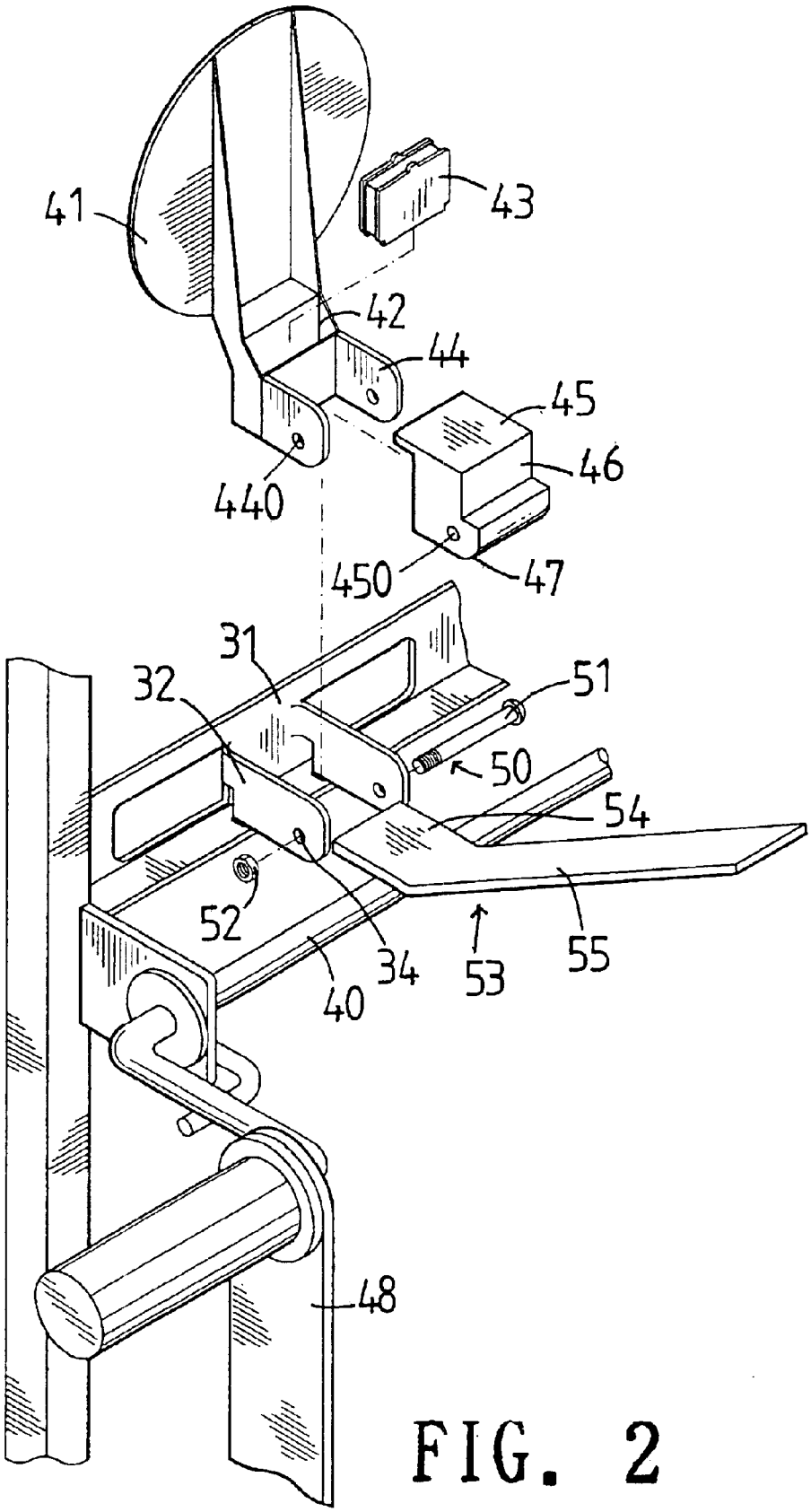
FIG. 2 is a partially cut-away exploded view of the target throw playing machine as shown in FIG. 1.
Figure 3:
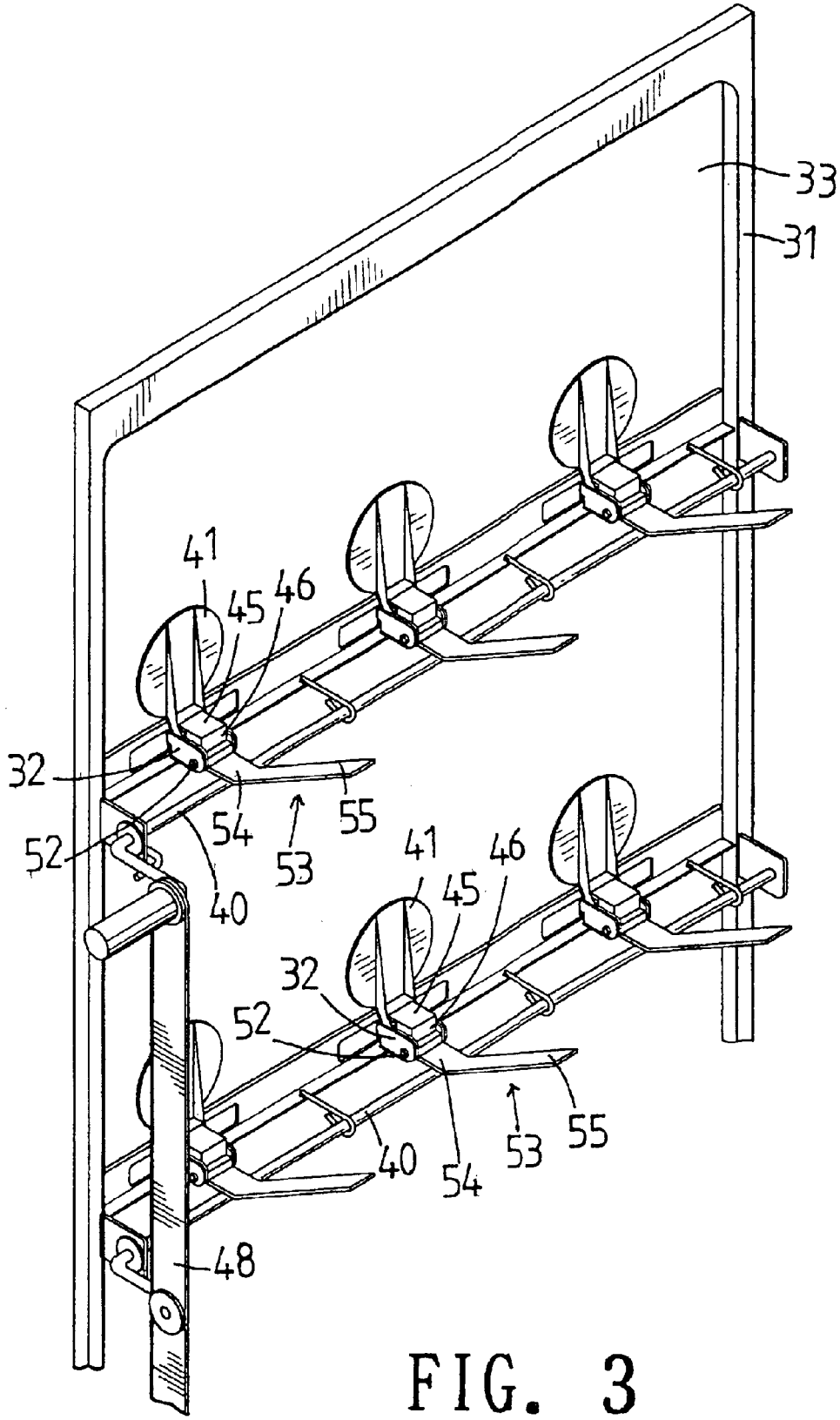
FIG. 3 is a rear perspective view of the target throw playing machine in accordance with the preferred embodiment of the present invention.

Referring to the drawings and initially to FIGS. 1–3, a target throw playing machine in accordance with the preferred embodiment of the present invention comprises a main frame 10, and a throw portion 30.

The main frame 10 includes two substantially inverted T-shaped support bars 11, and a circular frame 12 mounted between the two support bars 11.

The throw portion 30 is secured on a top of the main frame 10 and includes a front plate 31, a plurality of targets 41, and a plurality of shafts 40.

The throw portion 30 has a rear side provided with a net-shaped collection portion 20 and a front side having two sides each provided with a net-shaped catch portion 21. The catch portion 21 is pivotally mounted on the throw portion 30 by a movable rod 22.

Figure 6:
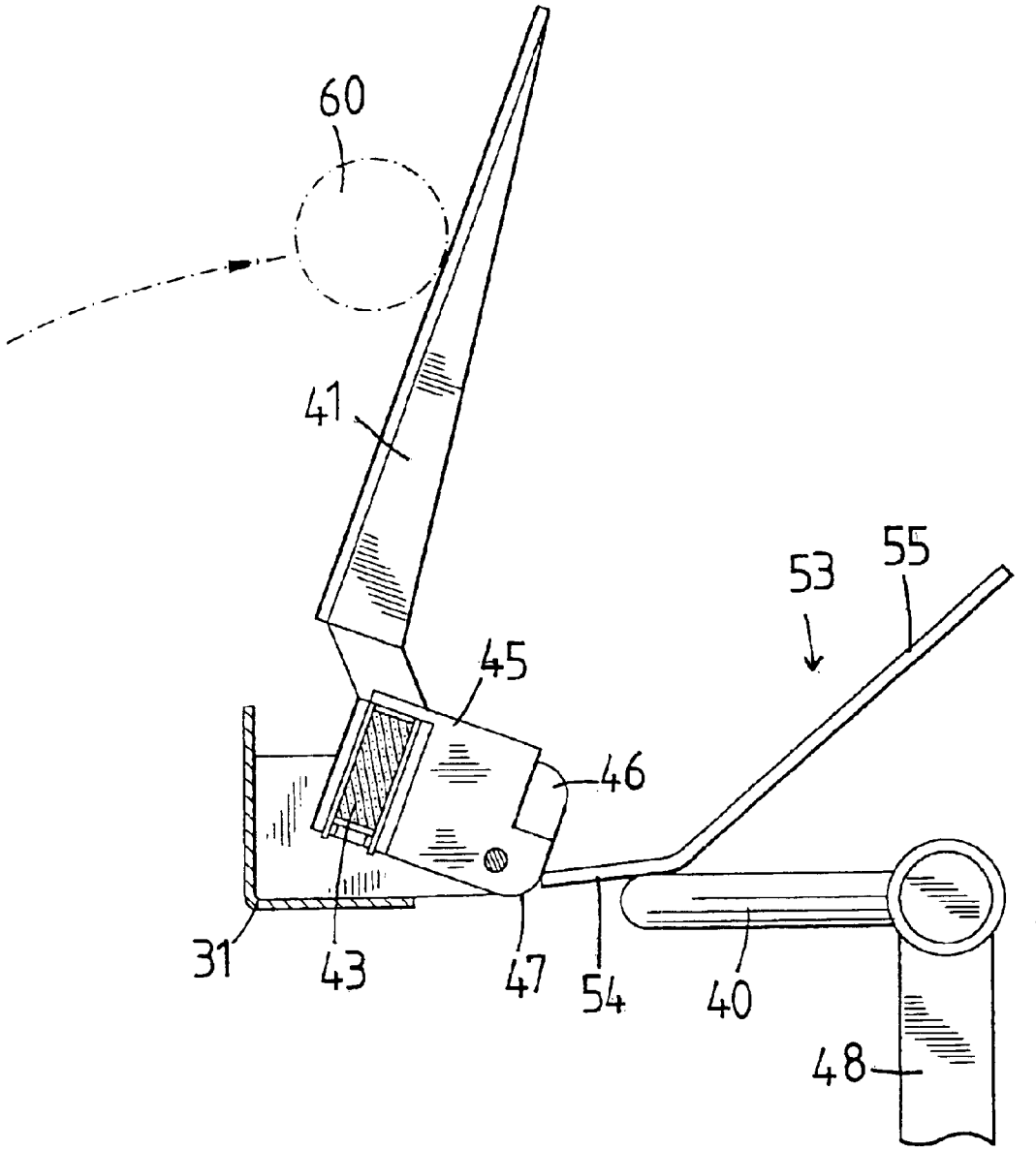
FIG. 6 is a schematic operational view of the target throw playing machine as shown in FIG. 5 in use.

The front plate 31 is formed with a plurality of openings 33 for passages of a ball (see FIG. 6). The front plate 31 has a rear end provided with multiple pairs of symmetrical wing plates 32 each protruded outward and each formed with a through hole 34.

Figure 5:
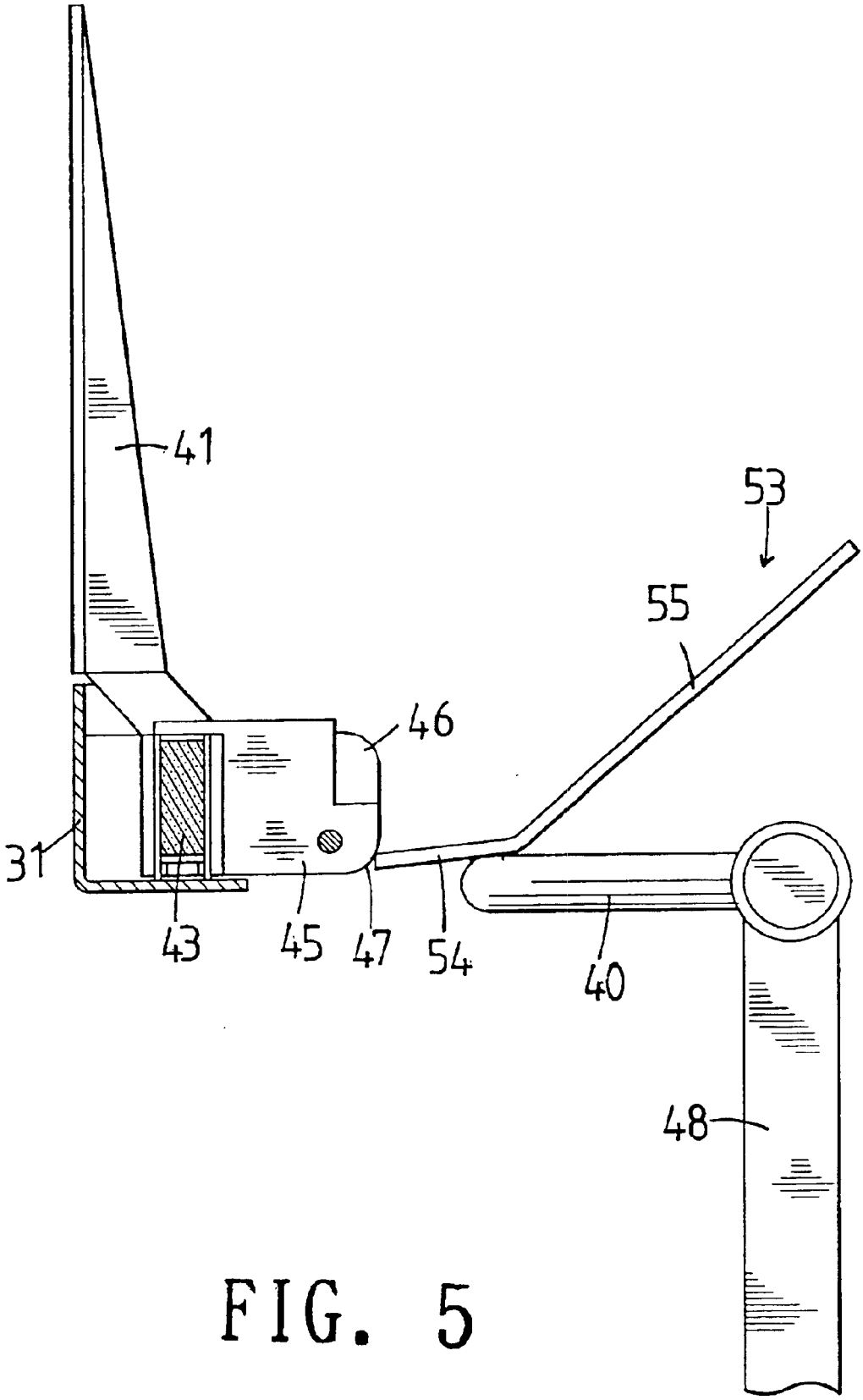
FIG. 5 is a side plan cross-sectional view of the target throw playing machine as shown in FIG. 4.

Each of the targets 41 is mounted on a rear portion of the front plate 31. Each of the targets 41 has a bottom pivotally mounted in a respective pair of the wing plates 32 of the front plate 31 and having a front end formed with a receiving recess 42 for receiving a magnetic member 43 and a rear end provided with a substantially U-shaped receiving chamber 44 for receiving a movable block 45. The bottom of each of the targets 41 is attracted on the front plate 31 by the magnetic effect of the magnetic member 43 as shown in FIG. 5.

The receiving chamber 44 of each of the targets 41 has two side walls each formed with a through hole 440 aligning with the through hole 34 of the respective wing plate 32 of the front plate 31.

The movable block 45 is substantially Z-shaped, and is secured on the respective target 41 to move therewith. The movable block 45 has an end formed with a cutout 46 and a chamfered portion 47. The movable block 45 is formed with a through hole 450 aligning with the through hole 440 of the receiving chamber 44 of the respective target 41.

The throw portion 30 further includes a plurality of positioning devices 50 each mounted between a respective one of the targets 41 and the front plate 31 for positioning the respective target 41 on the front plate 31. Each of the positioning devices 50 includes a positioning bolt 51 extended through the through holes 34 of the respective wing plates 32 of the front plate 31, the through holes 440 of the receiving chamber 44 of the respective target 41 and the through hole 450 of the movable block 45, and a positioning nut 52 screwed on the positioning bolt 51, so that the respective target 41 and the movable block 45 are pivotally mounted on the respective wing plates 32 of the front plate 31.

Figure 8:
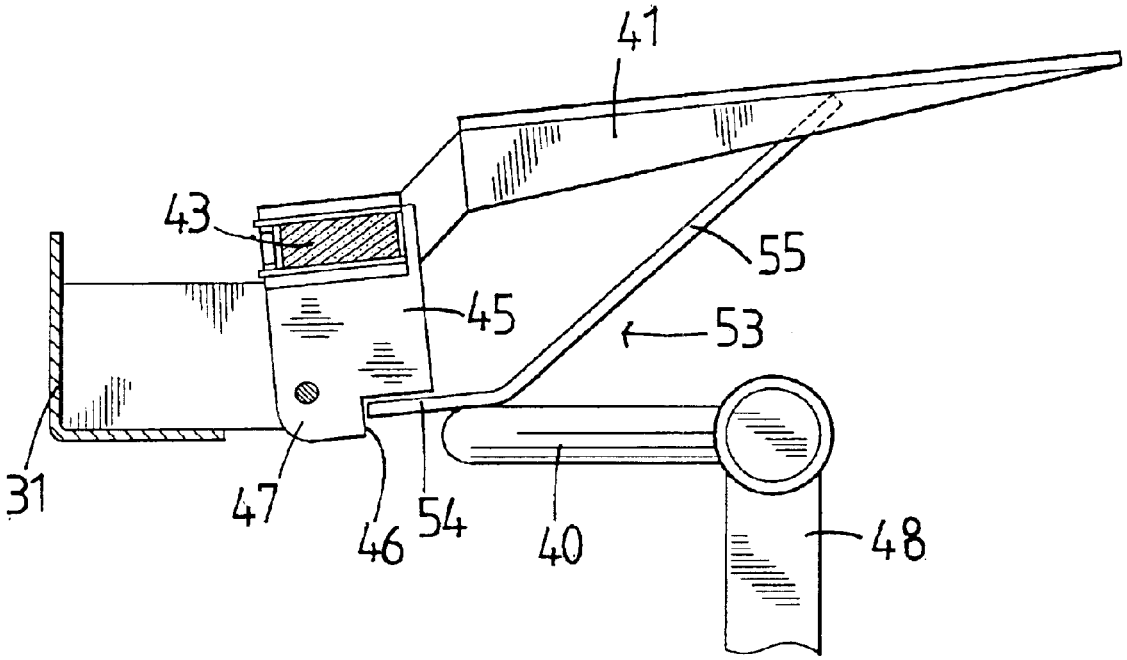
FIG. 8 is a schematic operational view of the target throw playing machine as shown in FIG. 6 in use.

Each of the shafts 40 is mounted on a rear portion of the front plate 31 and has two ends pivotally mounted the two sides of the front plate 31. Each of the shafts 40 is provided with a plurality of substantially V-shaped push members 53 each mounted on a respective one of the targets 41. Preferably, each of the push members 53 is secured on the respective shaft 40 to pivot therewith. In addition, each of the push members 53 has a first end 54 selectively rested on the chamfered portion 47 of the respective movable block 45 as shown in FIG. 5 or locked in the cutout 46 of the respective movable block 45 as shown in FIG. 8. In addition, each of the push members 53 has a second end 55 disposed at an inclined state for supporting the respective shaft 40 when the respective shaft 40 is pivoted downward to abut the second end 55 of the push member 53 as shown in FIG. 8.

Figure 4:
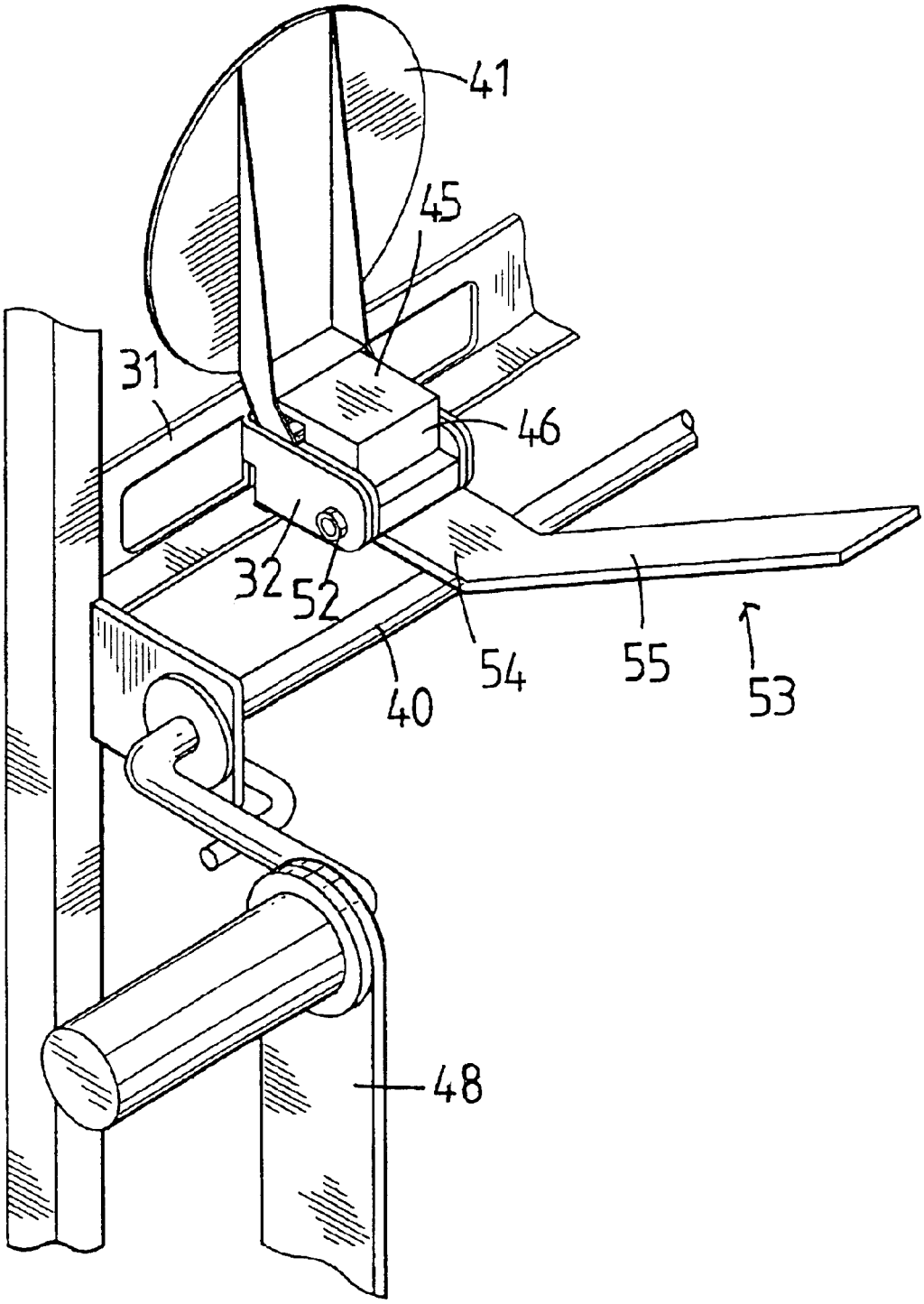
FIG. 4 is an exploded perspective assembly view of the target throw playing machine as shown in FIG. 2.

In operation, referring to FIGS. 4 and 5, when not in use, the bottom of each of the targets 41 is attracted on the front plate 31 by the magnetic effect of the magnetic member 43 as shown in FIG. 5, so that each of the targets 41 is disposed at an upright state as shown in FIG. 4. At this time, the first end 54 of each of the push members 53 is rested on the chamfered portion 47 of the respective movable block 45 as shown in FIG. 5.

Figure 7:
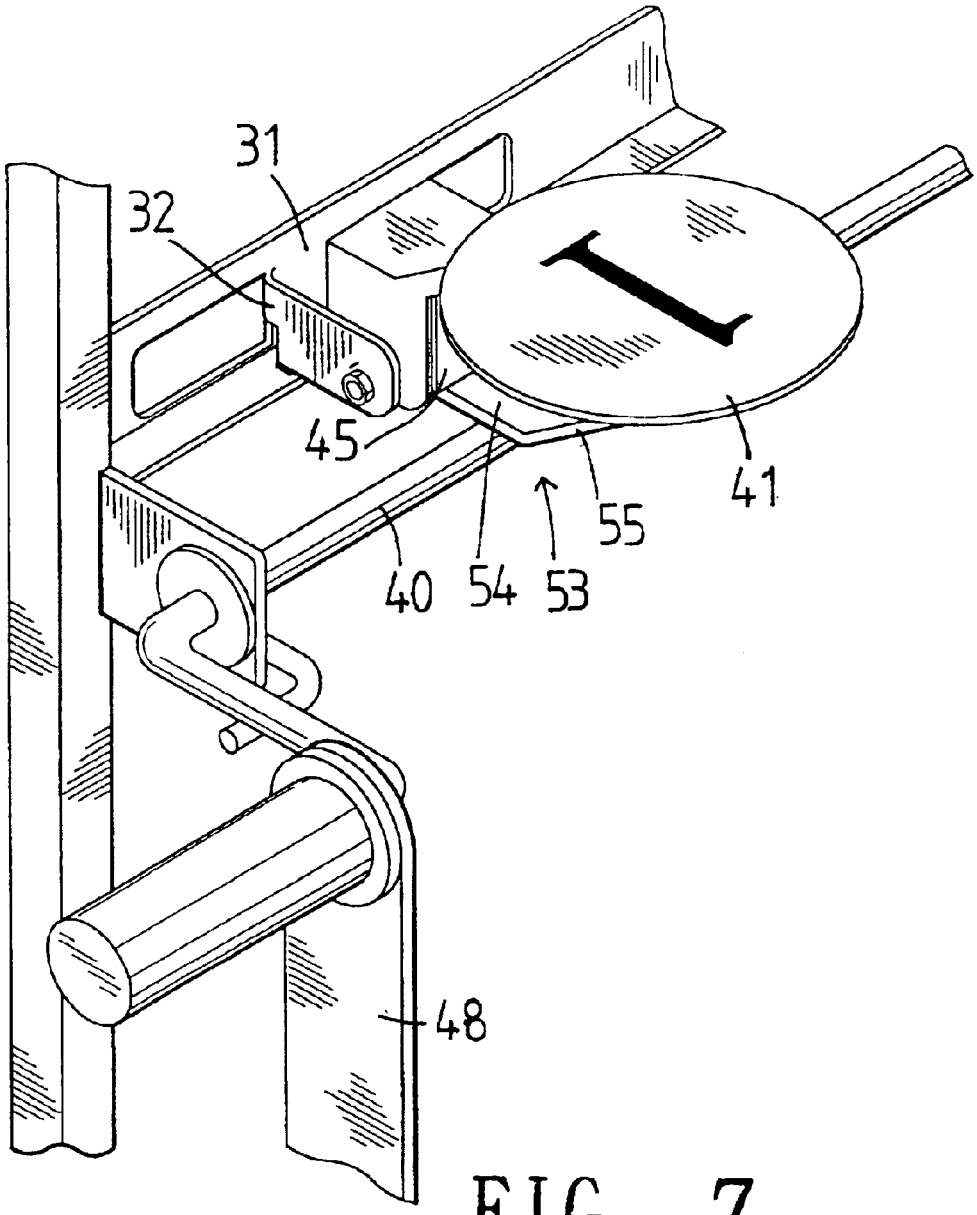
FIG. 7 is a schematic operational view of the target throw playing machine as shown in FIG. 4 in use.

When the ball 60 hits one of the targets 41 as shown in FIG. 6, the hitting force of the ball 60 overcomes the magnetic force of the magnetic member 43, so that the target 41 is pivoted downward about the positioning bolt 51 of the respective positioning device 50 to move from the position as shown in FIG. 6 to the position as shown in FIGS. 7 and 8, where the first end 54 of each of the push members 53 is locked in the cutout 46 of the respective movable block 45 and the target 41 is rested on the oblique second end 55 of each of the push members 53 as shown in FIG. 8.

In such a manner, the first end 54 of each of the push members 53 is locked in the cutout 46 of the respective movable block 45, so that the target 41 and the movable block 45 are locked by the respective push member 53 without movement, thereby preventing the target 41 from being returned to the original position due to the excessive hitting force of the ball 60.

Figure 9:
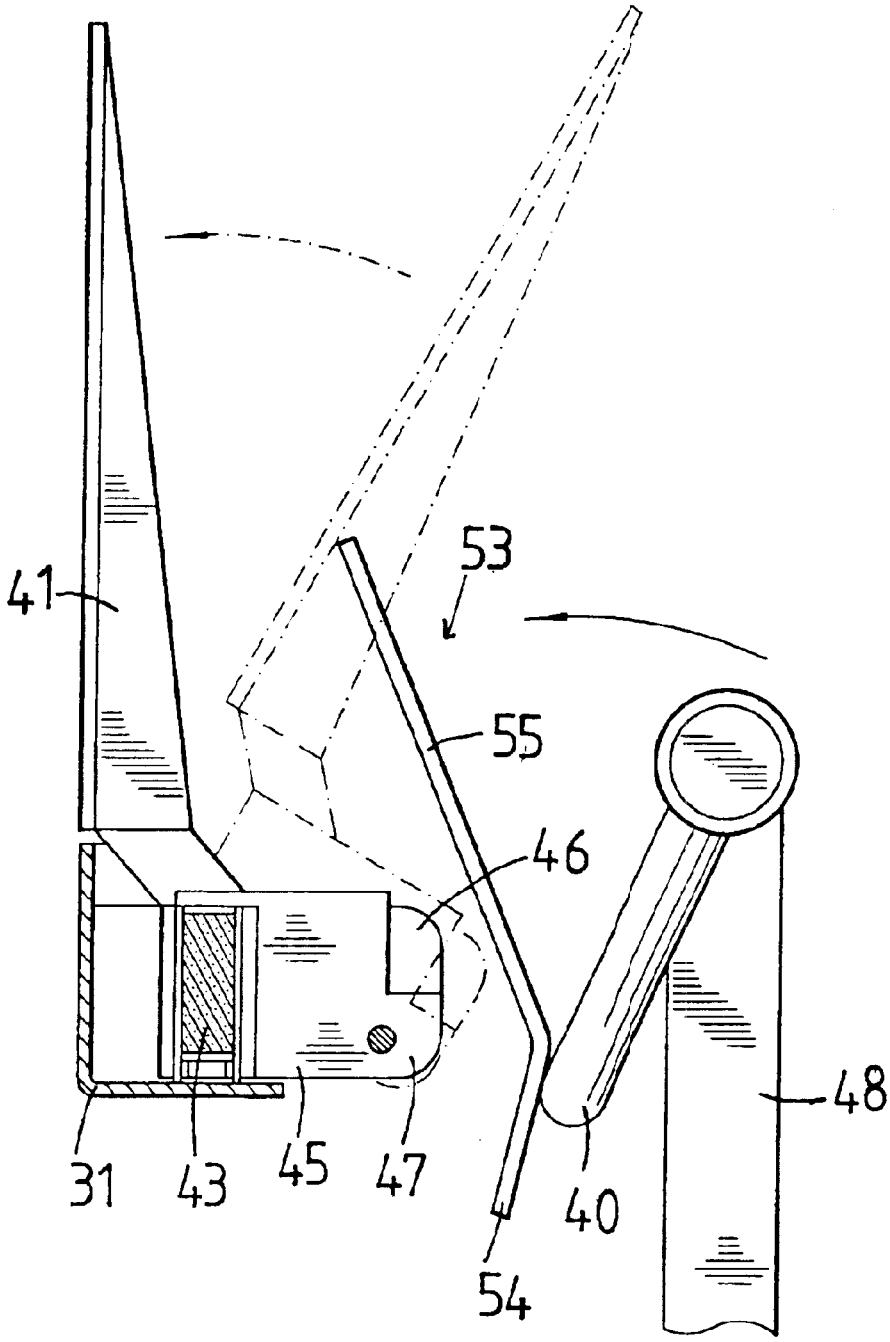
FIG. 9 is a schematic operational view of the target throw playing machine as shown in FIG. 8 in use.
Figure 10:
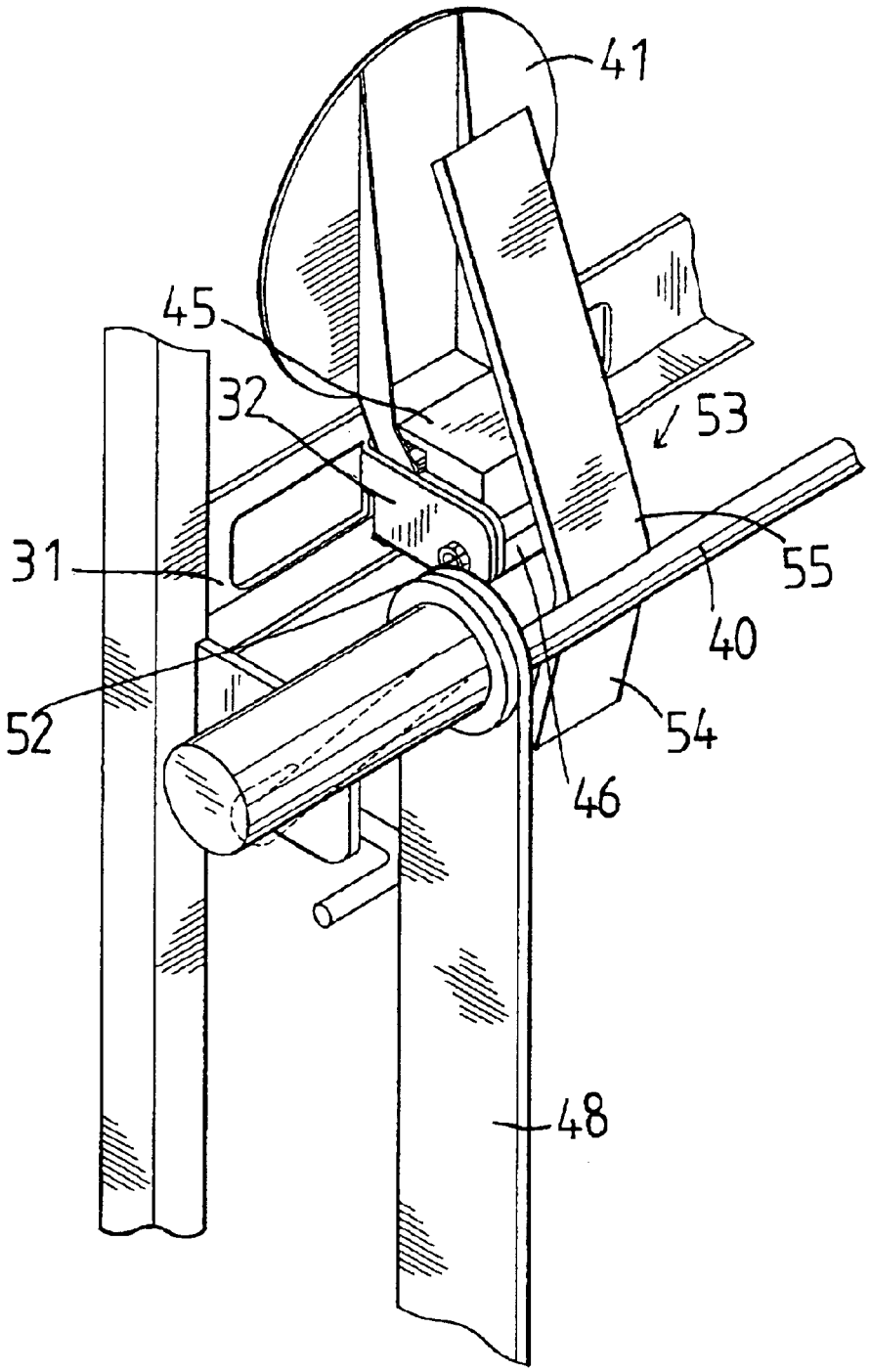
FIG. 10 is a schematic operational view of the target throw playing machine as shown in FIG. 7 in use.
Figure 11:
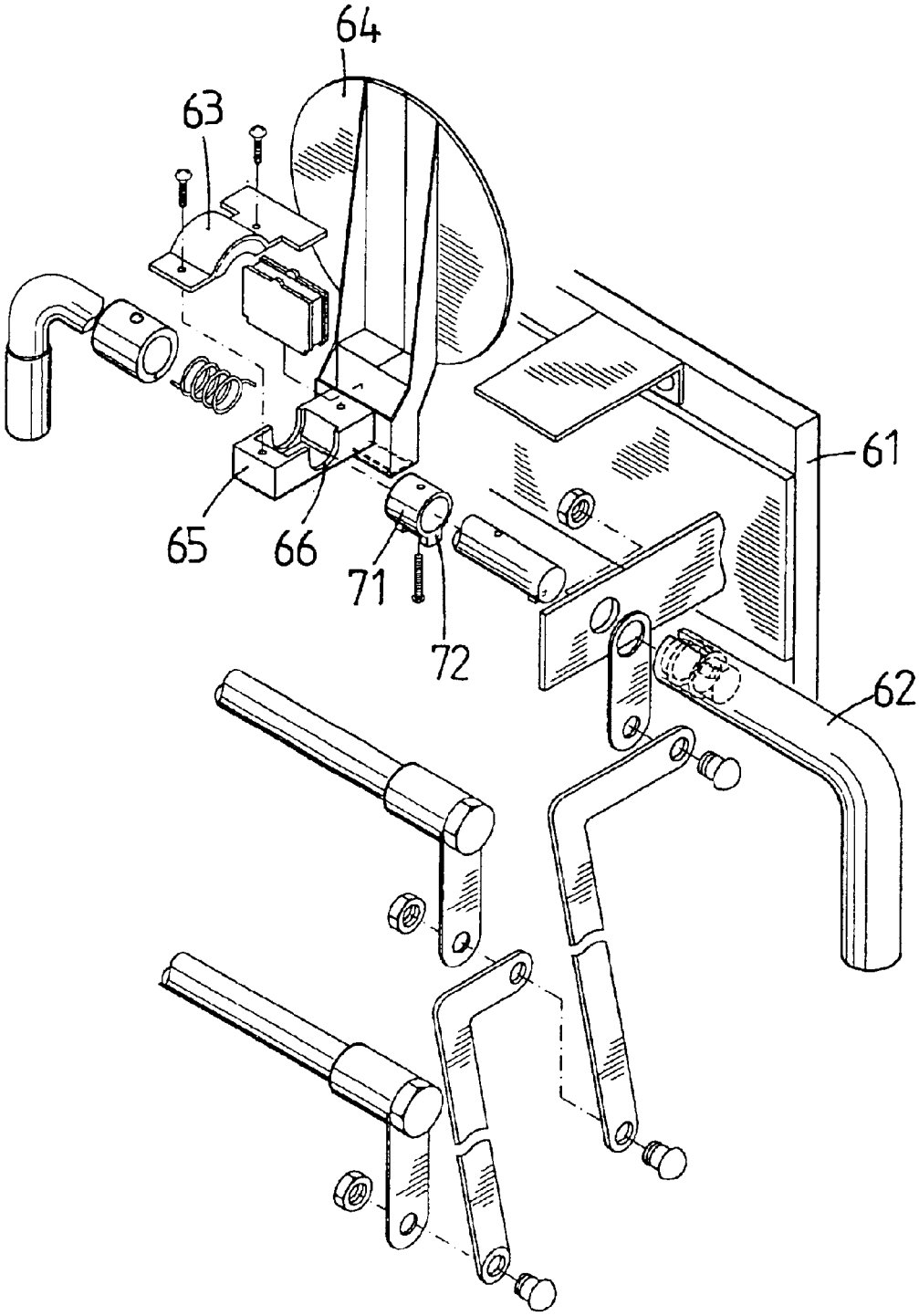
FIG. 11 PRIOR ART
FIG. 11 is an exploded perspective view of a conventional target throw playing machine in accordance with the prior art.
Figure 12:
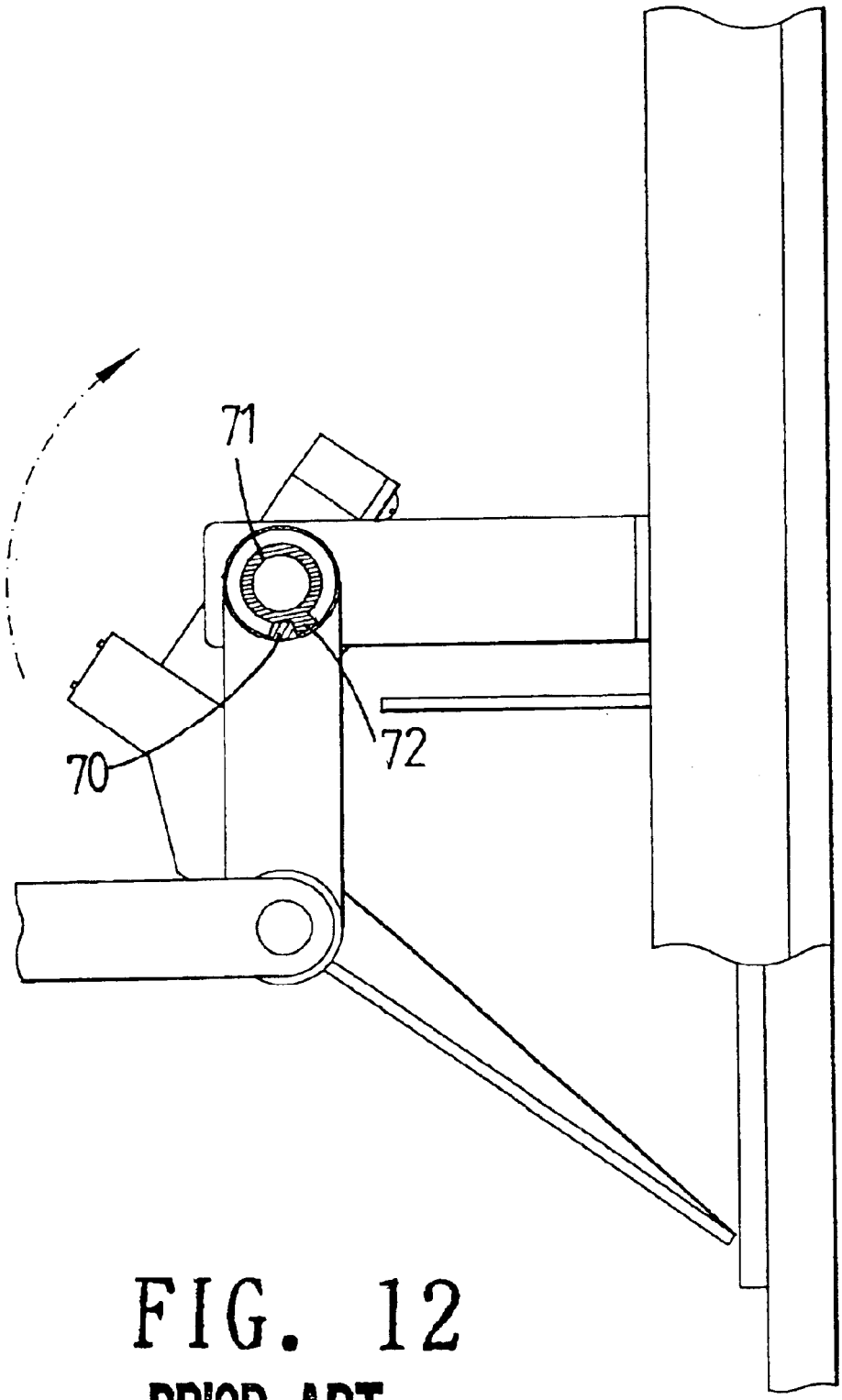
FIG. 12 PRIOR ART
FIG. 12 is a side plan cross-sectional assembly view of the conventional target throw playing machine as shown in FIG. 11.
Figure 13:
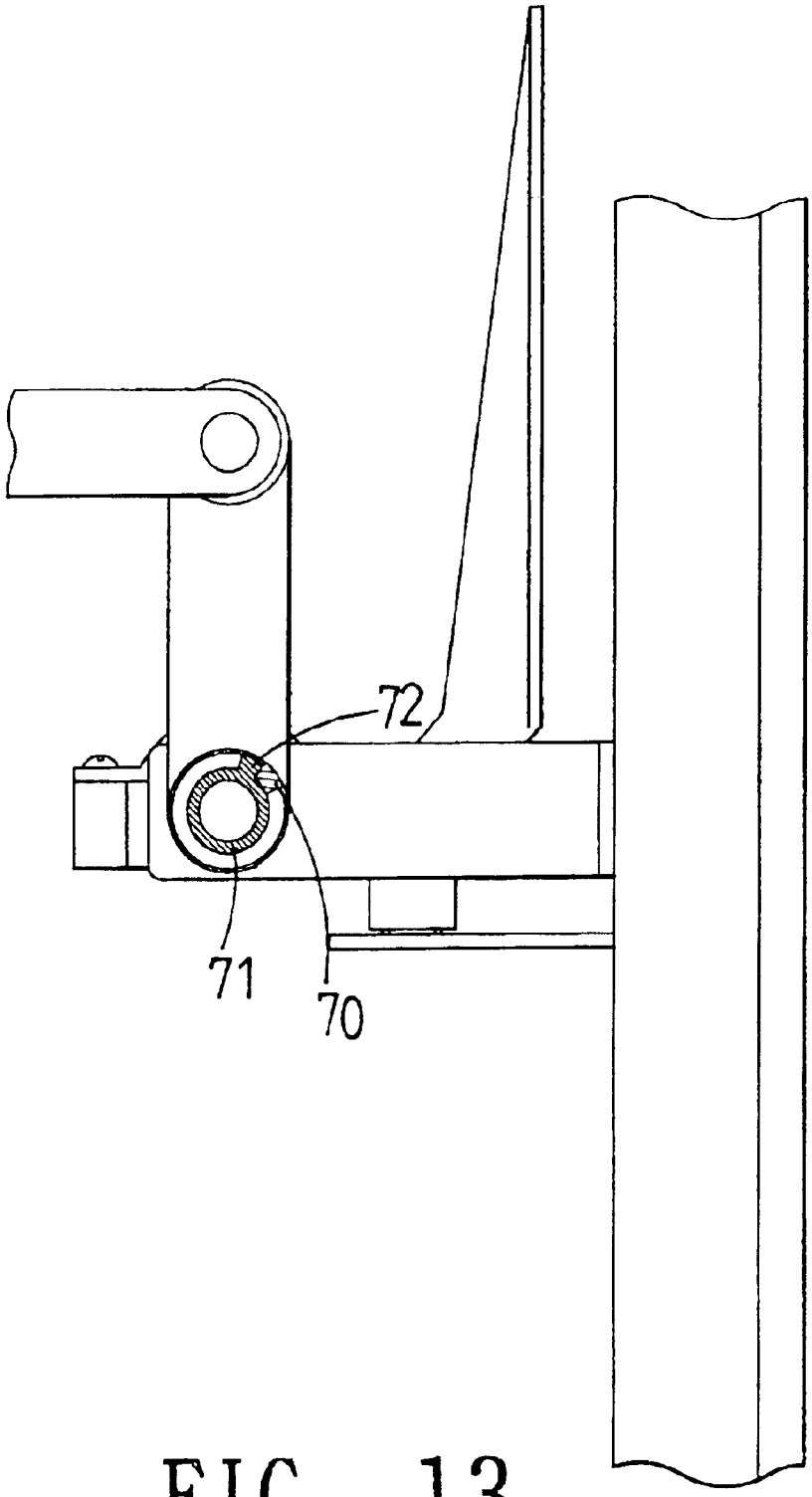
FIG. 13 PRIOR ART
FIG. 13 is a schematic operational view of the conventional target throw playing machine as shown in FIG. 12.

After the user finishes the throwing action of all of the balls 60, each of the shafts 40 is pivoted relative to the front plate 31 to pivot the push members 53, so that each of the push members 53 is moved from the position as shown in FIG. 8 to the position as shown in FIG. 9, thereby detaching the first end 54 of each of the push members 53 from the cutout 46 of the respective movable block 45. At this time, the oblique second end 55 of each of the push members 53 is moved to push the respective target 41, so that each of the targets 41 can be returned to the original position as shown in FIG. 10.

Preferably, the throw portion 30 further includes a longitudinal control lever 48 mounted between the shafts 40 so as to pivot the shafts 40 synchronously.

Accordingly, when the target 41 is hit by the ball 60, the target 41 is pivoted downward and is locked by the respective push member 53 without movement, thereby preventing the target 41 from being returned to the original position due to the excessive hitting force of the ball 60. In addition, each of the targets 41 can be returned to the original position automatically by push of the oblique second end 55 of each of the push members 53. Further, the target throw playing machine has a simplified construction, thereby decreasing costs of fabrication. Further, when the target 41 is pivoted downward, the target 41 is rested on the oblique second end 55 of the respective push member 53, thereby preventing the target 41 from being rotated excessively.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A target throw playing machine, comprising:

a main frame; and a throw portion mounted on the main frame and including a front plate, a plurality of targets, and a plurality of shafts, wherein:

the front plate is secured on a top of the main frame;

each of the targets is pivotally mounted on a rear portion of the front plate, and has a bottom provided with a movable block to pivot therewith;

the movable block has an end formed with a cutout and a chamfered portion;

each of the shafts is mounted on a rear portion of the front plate and is provided with a plurality of push members each mounted on a respective one of the targets; and each of the push members has a first end selectively rested on the chamfered portion of the respective movable block or locked in the cutout of the respective movable block.

2. The target throw playing machine in accordance with claim 1, wherein the front plate has a rear end provided with multiple pairs of symmetrical wing plates, and the bottom of each of the targets is pivotally mounted in a respective pair of the wing plates of the front plate.

3. The target throw playing machine in accordance with claim 2, herein the bottom of each of the targets has a rear end provided with a receiving chamber for receiving the movable block.

4. The target throw playing machine in accordance with claim 3, wherein the receiving chamber is substantially U-shaped.

5. The target throw playing machine in accordance with claim 3, wherein the throw portion further includes a plurality of positioning devices each mounted between a respective one of the targets and the front plate for positioning the respective target on the front plate.

6. The target throw playing machine in accordance with claim 5, wherein each of the wing plates is formed with a through hole, the receiving chamber of each of the targets has two side walls each formed with a through hole aligning with the through hole of the respective wing plate of the front plate, the movable block is formed with a through hole aligning with the through hole of the receiving chamber of the respective target, and each of the positioning devices includes a positioning bolt extended through the through holes of the respective wing plates of the front plate, the through holes of the receiving chamber of the respective target and the through hole of the movable block, and a positioning nut screwed on the positioning bolt, such that the respective target and the movable block are pivotally mounted on the respective wing plates of the front plate.

7. The target throw playing machine in accordance with claim 1, wherein the throw portion further includes a plurality of positioning devices each mounted between a respective one of the targets and the front plate for positioning the respective target on the front plate.

8. The target throw playing machine in accordance with claim 1, wherein the bottom of each of the targets has a front end formed with a receiving recess for receiving a magnetic member, so that the bottom of each of the targets is attracted on the front plate by the magnetic effect of the magnetic member, and each of the targets is disposed at an upright state.

9. The target throw playing machine in accordance with claim 1, wherein the movable block is substantially Z-shaped.

10. The target throw playing machine in accordance with claim 1, wherein the movable block is secured on the respective target to move therewith.

11. The target throw playing machine in accordance with claim 1, wherein each of the shafts has two ends pivotally mounted on two sides of the front plate.

12. The target throw playing machine in accordance with claim 1, wherein each of the push members is substantially V-shaped.

13. The target throw playing machine in accordance with claim 1, wherein each of the push members is secured on the respective shaft to pivot therewith.

14. The target throw playing machine in accordance with claim 1, wherein the each of the push members has a second end disposed at an inclined state for supporting the respective shaft when the respective shaft is pivoted downward to abut the second end of the push member.

15. The target throw playing machine in accordance with claim 1, wherein the throw portion further includes a longitudinal control lever mounted between the shafts so as to pivot the shafts synchronously.

* * * * *